United States Patent [19]

Gundlach

[11] 4,338,727

[45] Jul. 13, 1982

[54] SHADOWLESS SUNDIAL

[75] Inventor: Robert W. Gundlach, Victor, N.Y.

[73] Assignee: Vencraft Corporation, West Henreitta, N.Y.

[21] Appl. No.: 188,142

[22] Filed: Sep. 17, 1980

[51] Int. Cl.[3] ..... G04B 49/00

[52] U.S. Cl. ..... 33/269

[58] Field of Search ..... 33/269, 270, 271

[56] References Cited

U.S. PATENT DOCUMENTS 2,668,357 2/1954 Whipple ..... 33/270

2,846,768 8/1958 Putnam ..... 33/270

3,786,570 1/1974 Davies ..... 33/270

3,815,249 6/1974 Gundlach ..... 33/269

*Primary Examiner*—William D. Martin, Jr.

[57] ABSTRACT

A sundial is disclosed comprising specularly reflective convex surfaces that form virtual images of the sun in a separate plane or conical surface in which a numbered dial plate is mounted. The axis of revolution of the curved surfaces is mounted parallel to the axis of rotation of the earth and the time scale is also centered about this axis, but in a separate plane or cone located at a distance below the nearest reflective convex surface equal to the radius of said convex surface.

10 Claims, 5 Drawing Figures

SHADOWLESS SUNDIAL

BACKGROUND OF THE INVENTION

Prior to the 14th century, when the pendulum clock was invented, the sundial was the primary means for measuring time. Many varieties are still in use today, often more for decorative than functional purposes.

Generally, sundials use a style or gnomon arranged to cast a shadow on a time scale. The invention of the shadowless sundial is described in U.S. Pat. No. 3,815,249, and is based on the use of reflection highlights producing images of the sun. Time is marked by the changing position of these images relative to a fixed time scale. Because it requires no sharp pointer, or gnomon, to cast a shadow, and in fact can be used under a hazy sun that casts no discernable shadow, advantages of safety, attractivness, economy, ease of adjustment, accuracy, reliability, and enhanced usefulness are realized. One disadvantage of shadowless sundials disclosed in said patent, however, has been the need for a means to sight the reflection image of the sun from a point located precisely on the axis of revolution of the sundial. Except for very large embodiments, such as monuments, it is necessary to read the time with one eye closed to avoid parallax.

SUMMARY OF THE INVENTION

An object of the invention is to provide shadowless sundials that can be easily and quickly read without the need for alignment of the observer to a specific viewing position. The inventive improvement makes use of the discovery that each reflection image of the sun, formed by a glossy convex surface, is a virtual image in space, and separate surfaces bearing a time scale can be made to lie coincident with the set of virtual images. The use of this principle permits the design of shadowless sundials that can be accurately read with both eyes from any point generally in front of the time scale.

The improved shadowless sundial of this invention comprises a body having a reflective surface in the form of at least a segment having a substantially annular shape situated perpendicular to its axis of curvature, a mounting means connected to the body for maintaining the axis parallel to the axis of rotation of the earth, and a time scale positioned parallel to said body and maintained at a distance from the reflective surface equal to the radius of curvature of the body. As will be more fully described below, the virtual image formed by the reflective surface of the body is coincident with the time scale when the annular body is separated from the time scale by the distance equal to the radius of curvature of the body. With proper alignment of the device, the virtual image indicates the correct time on said time scale.

Further explanation of the inventive concept is made through the accompanying drawings wherein.

DETAILED DESCRIPTION

The drawings illustrate the principle of the invention as well as several embodiments of improved shadowless sundials using that principle. As described in U.S. Pat. No. 3,815,249, shadowless sundials have reflecting surfaces shaped to produce an image or a series of images of the sun, oriented and associated with a time scale for indicating the time position of the reflected image or images.

Figure 1:
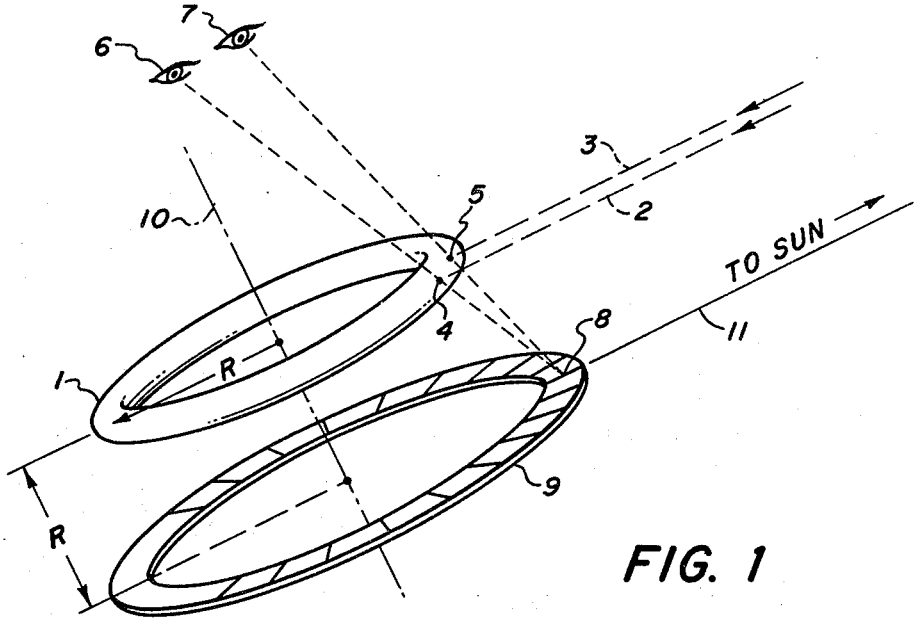
FIG. 1 is an isometric view of a single specularly reflective ring or toroid showing a right and left eye view of the sun's reflective highlight.

FIG. 1 shows a specular or glossy ring 1 positioned in a plane parallel with the earth's equator. In this illustration it is assumed the sun lies in the same plane, although in reality it lies in the equatorial plane during the spring and fall equinoxes only. At all other times it deviates from this plane up to $23\frac{1}{2}$ degrees. The sun's rays 2 and 3 form bright reflection highlights 4 and 5 when viewed from the right and left eye positions 6 and 7, respectively.

It has been discovered that the line drawn through points 6 and 4 intersects the line drawn through points 7 and 5 at a point 8 lying on an image plane 9 parallel to the plane of the ring 1 and separated from it by a distance exactly equal to the radius R of ring 1. A virtual image of the sun is thus formed by reflections from the ring 1 and is seen to be lying in the intersection plane, or image plane 9. The axis of revolution 10 of ring 1 intersects the image plane 9 at a point C. No matter where the observer views the ring 1 within an angle of about 30° or less from the central axis 10, the virtual image 8 of the sun's highlight is seen to fall on the line 11 extending from C to the sun in the image plane 9. When the sun is not exactly in the equatorial plane, line 11 is the line of intersection between image plane 9 and the plane defined by the axis of revolution 10 and the sun.

It will be clear that if a time scale is placed in the image plane 9 there will be no relative motion (i.e., no parallax) between the virtual image of the sun and the time scale as the observer changes viewing position. The sundial can be viewed from any position within about 30° of the axis of the ring.

Figure 2:
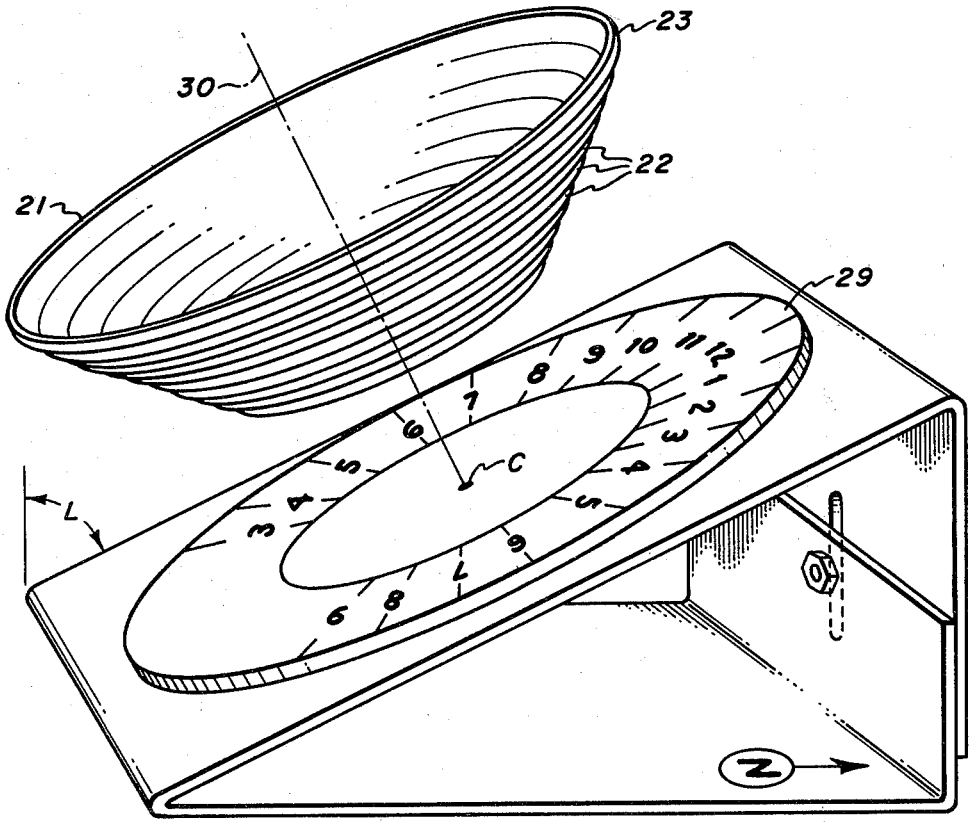
FIG. 2 is an isometric view of a transparent cone-shaped sundial embodying the present invention.

FIG. 2 shows an embodiment of the inventive concept wherein a series of reflection images of the sun is formed coincident with a planar surface bearing a time scale.

A transparent cone 21 of glass or clear plastic of the like is constructed so that its surface makes an angle of 45° with the axis of revolution 30. On its lower surface 23 are scribed circular lines or grooves 22 with centers of curvature on the common axis of revolution 30. A flat circular time-scale 29 is mounted perpendicular to axis 30 with its center C on axis 30 at the apex of the lower conical surface 23. It will be seen that under these conditions, each of the rings 22 will be spaced above the plane of the timescale 29 by a distance equal to the ring's own radius. Thus the reflective image of the sun formed by each of the rings 22 falls in the plane of timescale 29, forming a parallax-free coincidence of the line of highlight images and the markings of the timescale. The position of the line of images relative to the markings of the timescale indicates the time of day with a precision of one to two minutes.

Figure 3:
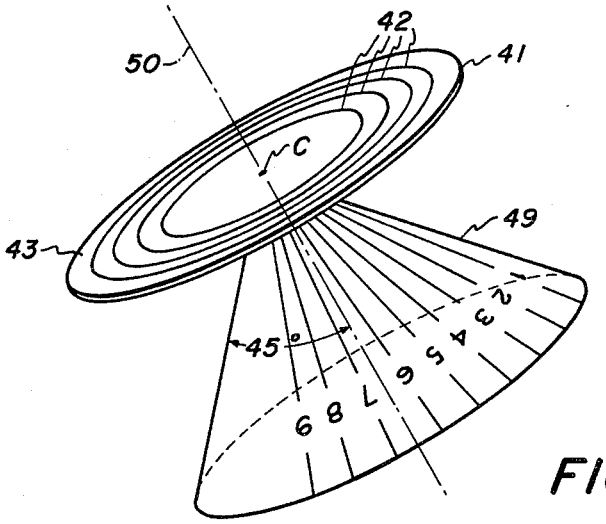
FIG. 3 is an isometric view of a fresnel lens sundial of the present invention.

FIG. 3 shows a sundial of the present invention consisting of a fresnel lens 41 as the source of reflective rings 42, which are concentric about point C, and lie in the plane of the upper surface 43 of the fresnel lens 41. The timescale of this example is printed on an inverted cone, positioned so that its image 49, as seen when viewed through the magnifying fresnel lens 41, falls on an imaginary conical surface with a 45° half angle; i.e., making an angle of about 45° with the axis of revolution 50, and with its apex at the center C of reflective rings 42. Thus, again, the line of highlight images is formed in space, coincident with the perceived image of the timescale 49, and no parallax will be seen on viewing the images. In this case the actual position for mounting the timescale depends upon the magnifying power of the fresnel lens 41, so that its virtual image falls in the above mentioned conical surface 49.

Such a planar-surfaced model reflection sundial as described in FIG. 3 is useful only in that half of the year that the sun lies above the equatorial plane; namely between the spring and fall equinoxes.

Figure 4:
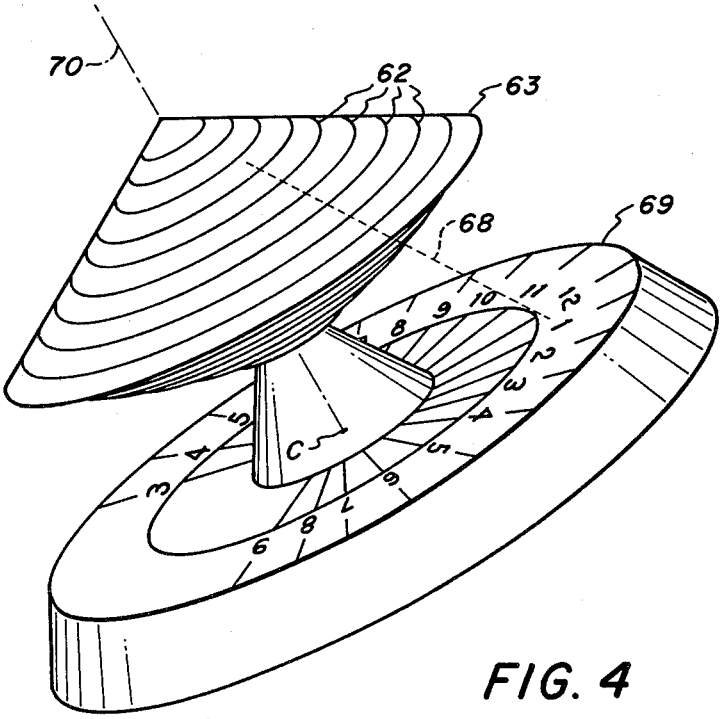
FIG. 4 is an isometric view of an opaque, glossy cone-shaped sundial of the present invention.

FIG. 4 shows a preferred embodiment of the present invention. An inverted cone of polished stainless steel, aluminum, chinaware, or other specularly reflecting surface is constructed so that the glossy surface 63 makes an angle of about 60° with the axis of revolution 70. This angle insures that the sun always illuminates the top surface 63, even on the winter solstice, when it lies 23½° below the equatorial plane. A set of paraxial circular scratches or grooves 62 mark surface 63 and produce reflection highlights of the sun as a virtual image consisting of a bright line floating in space, where each point of the line image is located below surface 63 at a distance equal to the radius of the groove producing it.

It can be shown that for a reflective cone making an angle $\theta$ with the axis of revolution 70, the virtual image will make an angle $\phi$ with the axis of revolution, where $$\phi = \tan^{-1} (\tan \theta)/(1+\tan \theta)$$

Thus, in the example of FIG. 4, the scored rings 62 on surface 63 making an angle of 60 ° with the axis of revolution 70 produce a virtual image consisting of a bright line 68 at 32.4° from the axis of revolution. This image falls on a line extending from the apex of cone 63 to the correct time on timescale 69.

Timescale 69 is mounted in a plane perpendicular to the axis of revolution 70 below the outer rim of surface 63 at a distance equal to the radius of the rim. The line of virtual images formed by paraxial rings 62 terminates in this plane, and therefore appears coincident with timescale 69.

The angle between reflective surface 63 and axis of revolution 70 is preferably less than about 66½°, so the sun will always illuminate the top surface 63, even on the day of the winter solstice, when the sun lies 23½° below the equatorial plane. On the other hand, the angle is preferably more than about 57°, because at that angle the sun's reflection becomes excessively bright on the summer solstice, when the sun reaches an angle of 23½° above the equatorial plane.

Figure 5:
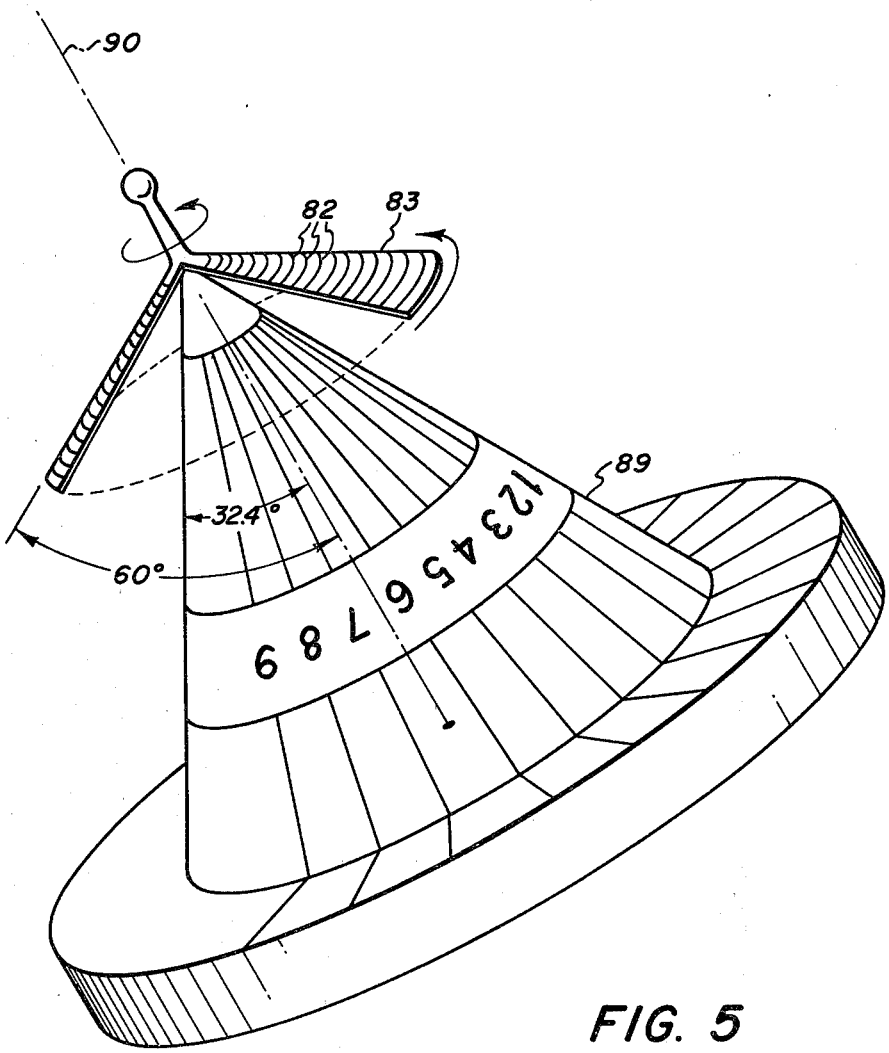
FIG. 5 is an isometric view of a sundial of the present invention employing a rotatable segment of a cone bearing reflective rings.

FIG. 5 shows an embodiment of the invention in which reflective rings 82 are formed on segments 83 of a conical surface of revolution. Said segments 83 are mounted on bearings allowing them to rotate on axis 90. By spinning reflective segments 83 rapidly, the viewer sees the sun's virtual images formed by coaxial grooves 82 as a line of highlight points falling coincident with conical surface 89, on which is printed a timescale of one hour every 15 degrees. Sufficient space is provided between segments 83 to afford a time averaged view of the timescale coincident with the sun's virtual image. The retentivity of the eye insures that, when reflective segments 83 are spun rapidly, the virtual images of the sun and the timescale are seen simultaneously. As discussed in relation to FIG. 4, the grooved conical surface of revolution 83 makes an angle of about 60° with said axis of revolution 90, while timescale cone 89 makes an angle of about 32.4° with said axis of revolution.

These and other examples will be evident from the teaching of the basic concepts of the invention. Many variations in materials and in the arrangement of parts may be made without departing from the principles underlying this invention within the scope of the appended claims.

I claim:

1. A shadowless sundial comprising:

a. a body having a specularly reflecting surface forming at least a segment of a substantially annular surface perpendicular to its axis of curvature, b. mounting means connected to said body for maintaining said axis approximately parallel to the axis of rotation of the earth, and c. time scale means mounted in a plane parallel to said body at a distance from said body equal to the radius of curvature of said body so as to be coincident with the virtual image formed by the sun's reflection from said reflecting surface.

2. The sundial of claim 1 wherein said reflecting surface is formed as rings of different radii generally perpendicular to said axis.

3. The sundial of claim 2 wherein said rings are in a generally conical form.

4. The sundial of claim 3 wherein said cone is transparent and makes an angle of about 45° with said axis and whose apex is at the center of a time scale in a plane perpendicular to said axis.

5. The sundial of claim 3 wherein said cone slopes downward from its apex at an angle of from about 57° to about 66½° with its axis of revolution, and said time scale lies in a plane below the outermost ring.

6. The sundial of claim 2 wherein said rings are arranged concentric and next to each other in the general form of a disk, and said timescale is seen as a convex cone at an angle of about 45° from said axis.

7. The sundial of claim 6 wherein said rings are formed as a fresnel lens.

8. The sundial of claim 2 wherein said timescale means is circular and includes means of mounting said scale for rotational movement about said axis.

9. The sundial of claim 1 wherein said reflecting surface is a specularly reflecting surface of revolution around said axis.

10. The sundial of claim 1 wherein said reflective surface comprises a rotatable segment or segments of revolution supported to permit rapid rotation about said axis of revolution, with sufficient space between segments to afford an intermittent view of the timescale and the sun's virtual image.

* * * * *